US005169454A

United States Patent [19]

Weil

[11] Patent Number: 5,169,454

[45] Date of Patent: Dec. 8, 1992

[54] METHOD AND APPARATUS FOR CLEANING OBJECTS WITH ENVIRONMENTALLY HARMFUL SOLVENTS, IN PARTICULAR HALOGENATED HYDROCARBONS

[76] Inventor: Peter Weil, Helene-Mayer-Ring 10, D-8000 Munich 40, Fed. Rep. of Germany

[21] Appl. No.: 499,540

[22] PCT Filed: Oct. 27, 1989

[86] PCT No.: PCT/EP89/01278

§ 371 Date: Jun. 26, 1990

§ 102(e) Date: Jun. 26, 1990

[87] PCT Pub. No.: WO90/04663

PCT Pub. Date: May 3, 1990

[30] Foreign Application Priority Data

Oct. 29, 1988 [DE] Fed. Rep. of Germany ... 8813603[U]

[51] Int. Cl.[5] ..... B08B 3/00; B08B 3/12

[52] U.S. Cl. ..... 134/10; 134/26; 134/34; 134/95.1; 134/98.1; 134/111

[58] Field of Search ..... 134/10, 11, 12, 26, 134/34, 95, 98, 111; 55/59, 74, 387, 385.12

[56] References Cited

U.S. PATENT DOCUMENTS 3,079,286 2/1963 Kearney et al. ..... 134/95
4,409,999 10/1983 Pedziwiatr ..... 134/95
4,560,417 12/1985 Bardina et al. ..... 134/26
4,844,743 7/1989 Koblenzer et al. ..... 134/10

*Primary Examiner*—Theodore Morris
*Assistant Examiner*—Saeed Chaudhry
*Attorney, Agent, or Firm*—Anderson Kill Olick & Oshinsky

[57] ABSTRACT

A method and an apparatus for cleaning objects with environmentally harmful solvents, particularly halogenated hydrocarbons, in a system which is substantially closed during the cleaning process provides a solution for simplifying the transporting and particularly the handling of such solvents, wherein the endangerment of persons and environment is simultaneously reduced to the lowest possible degree or completely prevented, and which achieves in particular an optimal utilization and recovery of the solvent.

This is achieved in that a portion of this solvent is conveyed into a processing space from a large-volume reservoir tank, in that the objects to be cleaned are subsequently wetted with the solvent located in the processing space and cleaned by means of it, the solvent is guided back out of the processing space into a collecting tank after one or more cleaning processes and/or the gas atmosphere in the processing space is filtered and cleaned prior to the removal of the cleaned objects.

Only one drawing is to be disclosed with reference to this.

11 Claims, 1 Drawing Sheet

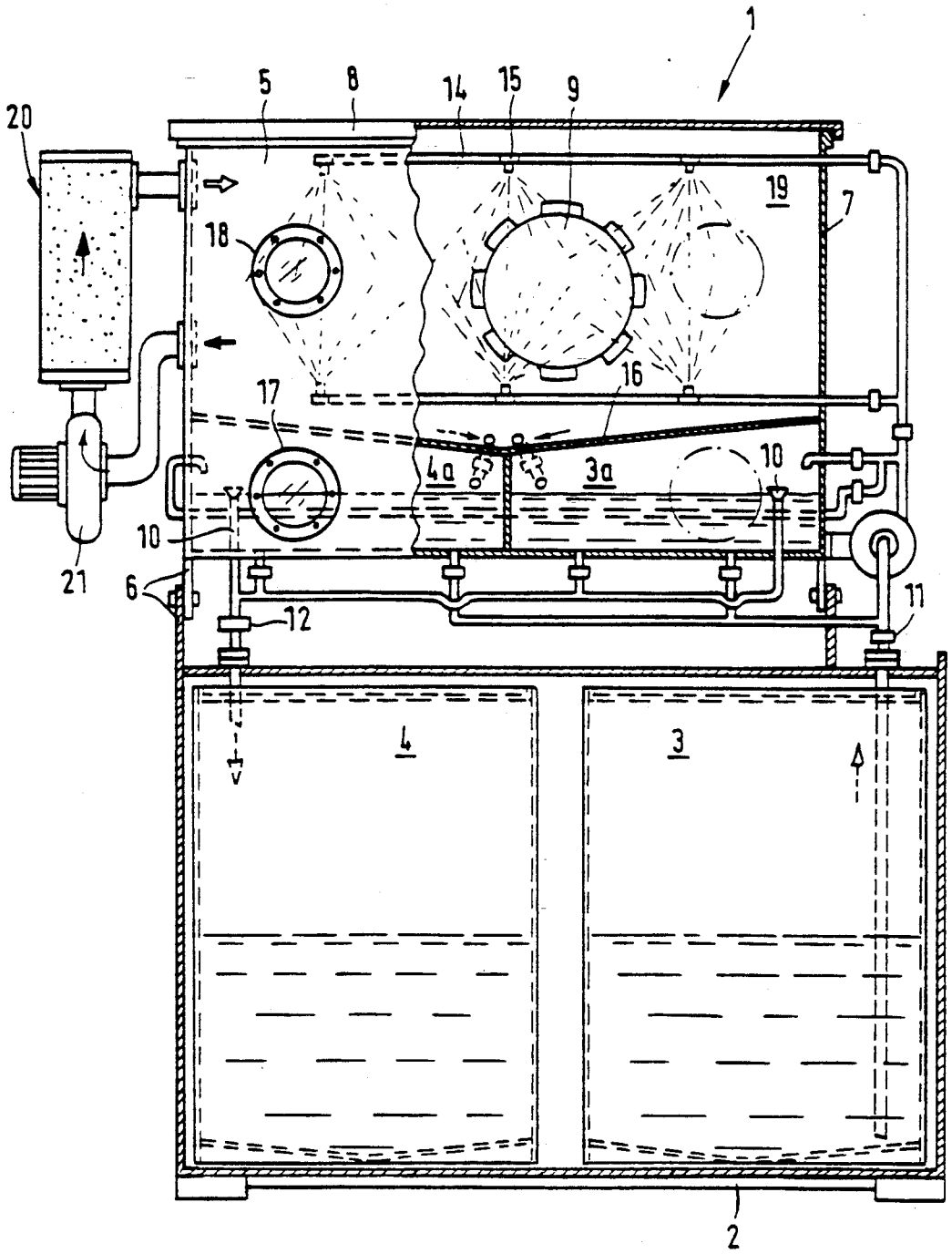
1
5
8
14
15
9
20
19
7
18
16
17
4a
3a
10
10
21
6
12
11
4
3
2

METHOD AND APPARATUS FOR CLEANING OBJECTS WITH ENVIRONMENTALLY HARMFUL SOLVENTS, IN PARTICULAR HALOGENATED HYDROCARBONS

BACKGROUND OF THE INVENTION

The invention is directed to a method for cleaning objects with environmentally harmful solvents, particularly halogenated hydrocarbons, in a system which is substantially closed during the cleaning process.

Solvents can lead to considerable damage to the environment due to inexpert storage, handling and transport or inexpertly returning them after they are contaminated to preparation plants or to storage, e.g. if they are spilled and enter the soil or groundwater. On the other hand, particularly dangerous materials, such as halogenated hydrocarbons (HKW), possess outstanding solvent properties for industry; they are also desirable because they are inflammable. However, legislation allows their use only in a very restricted scope, e.g. in such a way that only 10 l may be available per work place.

In particular, cold cleaning systems based on organic solvents are known in which the drying of the solvent is effected by air. Some systems are known which guide air via activated charcoal filters; however, emission into the environment is not reliably prevented. The weak points of known methods or apparatuses therefore lie in the handling, storage and transporting of such solvents.

SUMMARY OF THE INVENTION

Therefore, it is the object of the present invention to provide a solution which simplifies the transporting and, in particular, the handling of such solvents, wherein injury to persons and, environment is simultaneously reduced to a minimum or completely prevented, and which achieves an optimal utilization and recovery of the solvent in particular.

This object is met, according to the invention, with a method of the type named in the beginning in that a portion of this solvent is conveyed into a processing space from a large-volume reservoir tank of solvent, in that the objects to be cleaned are subsequently wetted with the solvent located in the processing space and cleaned by means of it, the solvent is returned to a collecting tank from the processing space after one or more cleaning processes and/or the gas atmosphere in the processing space is filtered and cleaned before the removal of the cleaned objects.

Cold cleaning methods in particular can be carried out practically in a closed system by means of the invention. A loading of the environment, particularly the surrounding air, is accordingly prevented. A very special advantage of the invention consists in the optimal utilization of a solvent by means of removing the solvent partially or by portions from the reservoir tank for fresh solvent and keeping this solvent available in the area of the processing space until it is so highly contaminated that it is returned for regeneration. When this degree of contamination is reached it can be guided back into the second tank. Accordingly, a comparatively pure or entirely pure solvent is always available for the user of the system.

It is provided with respect to construction that at least two reservoir chambers assigned to the processing space are used for substantially contaminated solvent on the one hand and for pure solvent on the other hand, wherein a pre-wash stage with the contaminated solvent is carried out prior to the main wash stage. This construction makes it possible to implement the method in a particularly economical manner and manages quantities of solvents carefully, wherein the frequency of regeneration of contaminated solvent is additionally reduced. Instead of two reservoir chambers, a plurality of corresponding reservoir chambers can also be provided which can receive a volume of solvent necessary for processing. In so doing, the degree of contamination in the chambers can increase by stages depending on the number of pre-wash stages; the most highly contaminated solvent is used for pre-washing in a pre-wash stage, a second pre-wash stage is carried out with the subsequent somewhat cleaner solvent until the final cleaning is finally effected with the cleanest solvent. If the degree of contamination in the most highly contaminated stage is so high that a pre-washing can no longer be reasonably carried out, this last quantity of solvent is then guided back into the collecting tank and an entirely pure, fresh quantity of solvent is supplied to the system again.

A very special advantage of the invention is noted here, which consists in that reservoir chambers can also be filled with chemically similar materials for application. Thus, for example, a cleaning of workpieces can be effected first and, after terminating the cleaning process, e.g. a corrosion inhibitor, stripping agent, coat of lacquer, adhesive coating or the like can be applied to the cleaned objects from the application chamber without having to remove the objects to be treated from the system.

In a further construction it is provided that a recovery of the gasified cleaning agent, and possibly a return of the condensate to one of the reservoir containers, is carried out when cleaning the gas atmosphere of the processing space. This method also helps to economize, since solvent which is present in the gas space is recovered. Of course, the object of the invention, namely not loading the environment with such solvents, is accommodated in a particularly advantageous manner in so doing; these solvents are completely recovered.

In order to meet the object described above, the invention also provides an apparatus which is equipped with two large-volume reservoir tanks for solvent and a handling container of smaller volume for solvent which is to be used at the time.

Such an apparatus has the advantage that larger quantities of solvent are available, but it can be ensured at the same time that only a low-volume reservoir is available for the user at the time, that is, that even small quantities can not be spilled as a result of inexpert handling.

It is provided with respect to construction that a collecting tank for used solvent is assigned to the handling container, wherein the reservoir tank, handling container and collecting tank are coupled in a working connection.

A special construction of the invention consists in that at least two reservoir chambers for clean or slightly contaminated solvent on the one hand and for more highly contaminated solvent on the other hand are assigned to the handling container. This results in the advantages described above, namely that there are always only small quantities of more or less highly contaminated solvent available in the cleaning system, the quantities being just sufficient for cleaning, and the return of a highly contaminated solvent from one of the reservoir chambers is only effected when a preliminary cleaning with this contaminated solvent is no longer necessary; rather, the contaminated solvent must be guided back for regeneration. This results in an optimal utilization of the solvent.

By means of this construction it can be achieved e.g. that the handling container is first flooded with the quantity of solvent assigned to it and after corresponding processing cycles and accordingly corresponding contamination of the solvent the latter can be drained off into the collecting tank. The handling container can now be flooded with fresh solvent again. The effective positive coupling of the containers enables a control such that a return flow of used solvent into fresh solvent is likewise prevented, as is an overfilling of the handling container.

In order to achieve a defined filling level of solvent in the handling container, the invention also provides an overflow line to the collecting tank. Accordingly, e.g. when the filling quantity of fresh solvent is too great, the excess solvent is guided directly into the collecting tank, i.e. the danger of the handling container overflowing, for example, is also prevented.

In order to prevent solvent from being spilled or from dripping on the work place unnecessarily, the invention also provides that the handling container is provided with a drip zone and/or an overflow gutter or drip gutter. The drip zone can be designed in such a way that the solvent drips directly back into the handling container or directly into the collecting tank.

The features of the apparatus described above, namely the overflow and drip zones, enable a half-open handling and processing, that is, when it is ensured by means of the overflow that less than 5 l of solvent is available in the processing space. Cleaning can be carried out manually e.g. with open cover; the cleaned part can then be removed after a certain quiescent period on the drip zone without the surrounding air being loaded with solvent.

In another construction it is provided that the gas space of the handling container is provided with a recirculating air cleaning device; this is provided in particular when processing spaces having a larger volume are also provided, which processing spaces can be closed in a positive coupling during the entire processing period.

In order to increase the action of the processing means the invention also provides for a circulating device and/or a spraying device and/or an ultrasonic oscillating device in the handling container, i.e. auxiliary means which are known per se in other connections. The invention also provides that the two reservoir tanks are arranged on a conveying pallet and/or that the handling container is constructed so as to form one piece with the conveying pallet and the tank arranged on the latter.

Other advantages of the apparatus described above substantially consist in that a restriction on high-grade solvents which are harmful to the environment need no longer be implemented in the work place. A constantly secure management of the solvent is ensured by means of a positive coupling, so that there is no contamination of persons or of the environment, particularly when filling and emptying the handling container. There is always fresh solvent available which can be used in small quantities. The fresh and used materials can be conveyed in simple transport systems to the end user without the latter coming into contact with them; a careful storage of the environmentally harmful used materials in the collecting tank is ensured in particular.

As a result of the substantially complete collecting of the used materials, the solvents can be prepared again in an optimal manner, i.e. an unloading of the environment is also ensured to this extent; moreover, the preparation operations can eliminate the residues found in the solvent.

BRIEF DESCRIPTION OF THE DRAWING

The invention is explained in more detail in the following by way of example by means of the drawing. The FIGURE shows a side view of a large-volume apparatus, according to the invention.

DETAILED DESCRIPTION OF THE PREFERRED EMBODIMENTS

The apparatus, designated in general by 1, comprises a transporting pallet 2, a large-volume reservoir tank 3 for solvent, a collecting tank 4 for used solvent, and a handling tank, designated in general by 5, which is arranged on a trough frame 6 above the reservoir tank 3 and the collecting tank 4 in the example.

The handling tank 5 is constructed in the example as a closed housing 7 with a cover 8. The handling tank 5 comprises two reservoir chambers 3*a* and 4*a* in the base area, wherein it is noted here that there can also be more than two such reservoir chambers. Each of these reservoir chambers has a volume sufficient for receiving a quantity of solvent, the latter being contaminated to a greater or lesser degree or pure, which is sufficient for the entire treatment process.

The workpiece to be treated, designated by 9, is located in the interior of the handling tank 5. At least one overflow connecting piece 10 is provided in the handling tank 5 for regulating the filling level.

The reservoir tank 3 is connected with the handling tank 5 via a coupling 11 and a coupling pipe. In addition to the overflow 10, the handling tank 5 can also be coupled with the collecting tank 4 by means of an additional coupling 12 in the coupling pipe. The couplings 11 and 12 can be electrically connected with a computer, not shown in more detail.

In the interior of the tank 5, a spraying device 14 is provided with spray nozzles 15 in order to spray the workpieces to be processed. The sprayed solvent is guided back via a drip zone and the inclined base 16 into the respective lower reservoir chambers 3*a* and 4*a* of the tank 5; the filling level can likewise be monitored via sight glasses 17, as can the spraying operation via sight glasses 18, which is only suggested in the drawing.

The gas space of the tank 5, designated in general by 19, is coupled to a recirculating air cleaning device 20; the air is guided via a suction fan 21, e.g. through an activated charcoal filter, and pumped back into the air space 19. A condensation device for solvent (not shown in more detail) can be provided, with a possibility for returning the solvent either directly into one of the reservoir tanks 3 or 4 or into the tank 5 if the tank 5 has a very large volume.

Both the cover 8 and the blocking devices can be equipped electronically in such a way that the locks are released only when there is a coupling between the reservoir tank 3 and the handling tank 5, as well as the collecting tank 4. The circuit can be effected in such a way that, when opening, the cover 8 can first only be opened when the air in the gas space 19 is cleaned in order to prevent a whirling of the air over the solvent zone caused by lifting the cover. When closing, the circuit can be effected in the reverse manner in such a way that a filling of the handling container 5 with solvent is possible only when covering the handling container by means of the horizontal covering 8.

The apparatus operates in the following manner: First, the workpiece or workpieces 9 to be treated are inserted into the gas space 19 of the container 5. Assuming that neither of the two reservoir chambers 3*a* or 4*a* is filled, one of the chambers is first flooded with a quantity of solvent such as is sufficient for the cleaning. The connection between the reservoir tank 3 and the handling tank 5 is then blocked.

The workpiece 9 is now sprayed from the reservoir chamber 3*a* via the spraying device 15. In so doing, the solvent always flows into the reservoir chamber 3*a*. After concluding the cleaning process and possibly after cleaning the air via the recirculating air cleaning system 20, the cleaned workpiece 9 can be removed. The reservoir chamber 3*a* remains closed relative to the surroundings with the solvent which is now somewhat contaminated. After inserting another workpiece to be cleaned, a preliminary cleaning can now begin by means of the solvent in the chamber 3*a*. When this is concluded, after all the solvent which is now contaminated to a greater extent is returned to this chamber, the chamber 4*a* is flooded with fresh solvent; the final cleaning of the workpiece 9 can then be effected by means of this entirely pure solvent.

If the solvent in the chamber 3*a* or chamber 4*a* is so highly contaminated compared to the other amount of solvent in the other preliminary chamber that it is no longer possible to effect the subsequent or final cleaning with it, the preliminary cleaning means are guided into the collecting tank 4 for the final time. If all of the pure solvent is used up gradually, the system can be exchanged and the contaminated solvent regenerated. This also applies to the filter which can likewise be regenerated when recovering the solvent.

Naturally, the described embodiment example of the invention can be modified in a number of ways without departing from the basic concept. Thus, for example, with containers having a smaller volume, e.g. which can be filled with only 5 l, the cover can be omitted; a loop suction of the container air or the like can possibly be provided. The apparatus can also be utilized for cleaning e.g. automatic spray heads, or the like, at robot arms during the inactive periods of the spray heads, the latter being used for processing adhesive, foam or the like hardening materials; this can be effected, for example, in that the robot arm is introduced into the gas space 19 of the container 5 via a lock, cleaned after locking the locks, possibly dried with air and can then be moved into the working position again via the lock without loading the environment.

I claim:

1. Apparatus for cleaning objects with environmentally harmful solvents, comprising:

two-large-volume reservoir tanks (3, 4) for holding cleaning solvent;

an openable and closable handling container (5) for solvent which is in use, said container defining a processing space for an object to be cleaned and having a volume smaller than that of the reservoir tanks; wherein at least two reservoir chambers (3*a*, 4*a*), one for clean or slight contaminated solvent and another for more highly contaminated solvent, are arranged on the handling container (5);

means for conveying the cleaning solvent from one of the reservoir tanks to the processing space only when said handling container is closed; and means for removing the cleaning solvent from the processing space, said handling container only being openable after the cleaning solvent is removed from the processing space.

2. Apparatus according to claim 1, wherein another of the large-volume tanks is a collecting tank (4) for used solvent assigned to the handling container, the one reservoir tank (3), handling container (5) and collecting tank (4) being coupled in a cooperatively working manner.

3. Apparatus according to claim 2, and further comprising:

a cover (8) for the handling container (5), which cover is positively controlled for opening;

a blocking device for the cover of the handling container (5), which blocking device is immediately connected with couplings (11, 12) between the handling container (5) and the reservoir tank (3) and collecting tank (4) in a working connection.

4. Apparatus according to claim 2, wherein at least one of an overflow line (10) to the collecting tank (4) is provided in the handling container (5) so as to ensure a maximum solvent filling level, and the handling container (5) is provided with at least one of a drip zone and an overflow gutter or drip gutter.

5. Apparatus according to claim 2, wherein the two reservoir tanks (3, 4) are arranged on a conveying pallet (2).

6. Apparatus according to claim 1, wherein the handling container (5) has a gas space, and further comprising a recirculating air cleaning device in connection with the gas space of the handling container.

7. Apparatus according to claim 1, and further comprising at least one of a circulating device, a spraying device (15) and an ultrasonic oscillating device provided in the handling container (5).

8. A method for cleaning objects with environmentally harmful solvents, particularly halogenated hydrocarbons, comprising the steps of:

providing a closable housing that defines a processing space for cleaning the objects;

providing a reservoir tank for clean solvent;

providing at least one reservoir chamber for solvent;

providing a collecting tank for contaminated solvent;

initially filling the at least one reservoir chamber with clean solvent;

placing an object to be cleaned in the processing space and closing the housing;

preliminarily cleaning an object, only when the housing is closed, with solvent from said at least one reservoir chamber, solvent used in the preliminary cleaning draining back into the at least one reservoir chamber;

final cleaning of the object with clean solvent from the reservoir tank, which solvent, after the final cleaning, is contaminated and drained into the at least one reservoir chamber so that no solvent is present in the processing space;

conveying the contaminated solvent to a collecting tank after the contaminated solvent reaches a certain filling level in the at least one reservoir chamber; and opening the housing to remove the cleaned object only when no solvent is present in the processing space.

9. A method as defined in claim 8, wherein said step of providing at least one reservoir chamber, includes providing at least two reservoir chambers, a first of the reservoir chambers containing solvent which is more contaminated than solvent in a second of the reservoir chambers, the reservoir chambers being arranged so that the second reservoir chamber has an overflow to the first more contaminated reservoir chamber, the step of conveying contaminated solvent to the collecting tank occurring from the first more contaminated reservoir chamber.

10. A method as defined in claim 9, wherein the preliminary cleaning step includes performing a first preliminary cleaning using solvent from the first reservoir chamber with a highest degree of contamination, and then a second preliminary cleaning with solvent from the second reservoir chamber with less contaminated solvent, the final cleaning step then taking place with the fresh solvent from the reservoir tank.

11. A method as defined in claim 8, and further comprising the step of recovering gasified cleaning agent and returning condensate thereof into the at least one reservoir chamber.

* * * * *